US007299748B2

(12) United States Patent
Petersen et al.

(10) Patent No.: US 7,299,748 B2
(45) Date of Patent: Nov. 27, 2007

(54) LOCKING EMBOSSER STAMP

(76) Inventors: Craig J. Petersen, 410 Meacham, Park Ridge, IL (US) 60068; Thomas P. Govern, 5005 Doral Ct., Plainfield, IL (US) 60544

( * ) Notice: Subject to any disclaimer, the term of this patent is extended or adjusted under 35 U.S.C. 154(b) by 9 days.

(21) Appl. No.: 11/404,153

(22) Filed: Apr. 14, 2006

(65) Prior Publication Data

US 2006/0230951 A1 Oct. 19, 2006

Related U.S. Application Data

(60) Provisional application No. 60/671,440, filed on Apr. 15, 2005.

(51) Int. Cl.
*B44B 5/00* (2006.01)

(52) U.S. Cl. ..... 101/31.1; 101/3.1

(58) Field of Classification Search ..... 101/3.1, 101/31.1, 28, 32

See application file for complete search history.

(56) References Cited

U.S. PATENT DOCUMENTS

| | | | | | |
|---|---|---|---|---|---|
| 1,471,688 | A | * | 10/1923 | Eyman | 101/31.1 |
| 1,646,612 | A | * | 10/1927 | Corey | 101/31.1 |
| 1,744,114 | A | * | 1/1930 | Gibson | 101/31.1 |
| 2,706,448 | A | * | 4/1955 | Priesmeyer | 101/31.1 |
| 5,787,802 | A | * | 8/1998 | McNab | 101/4 |

* cited by examiner

*Primary Examiner*—Leslie J. Evanisko
(74) *Attorney, Agent, or Firm*—Knechtel, Demeur & Samlan

(57) ABSTRACT

A locking mechanism for an embosser stamp in which the embosser stamp has an operating lever for controlling movement of the seal or embossing plates. Holes are disposed in the sides of the embosser stamp and through the operating lever. When the holes in the operating lever are aligned with the holes in the sides of the embosser stamp, a locking rod is placed through the aligned holes. Movement of the operating lever is restricted when the locking rod is inserted through the aligned holes. One end of the locking rod has a stop mechanism and the other end has a hole for receiving a lock.

13 Claims, 3 Drawing Sheets

LOCKING EMBOSSER STAMP

CROSS-REFERENCE TO RELATED APPLICATION

This patent application is a non-provisional application claiming priority from U.S. Provisional Application Ser. No. 60/671,440, filed on Apr. 15, 2005.

BACKGROUND AND SUMMARY OF THE INVENTION

This invention relates to embosser stamps and more particularly to a locking mechanism used on embossing stamps. Embossing stamps have an embossing seal used to make an impression or embossment on an article, generally a sheet of paper placed between the two halves of the seal. Often there is a need to lock up official seals of corporations, schools, and professionals to prevent their unauthorized use. This invention provides a locking mechanism for an embosser stamp that accomplishes the locking of the seal on the embossing stamp itself. This prevents the unauthorized of the stamp unless the locking mechanism is unlocked.

The invention comprises an embossing stamp of conventional design. There is a seal operated by a lever mechanism that causes the two halves of the seal to come into intimate contact with each other. The sheet material is placed between the halves when they are separated and when the two halves are pressed together the embossing on the sheet material occurs. Openings or slots are cut into the lever and the top of the stamp body so that the slots will line up when the lever is in the depressed position and the embossing surfaces of the seal are closed and seated against each other. A T-shaped member is placed through the slots and a suitable lock is inserted into a hole at one end of the T-shaped member. The vertical portion of the T-shaped member further assists in preventing the embossing surfaces from being exposed and used. The vertical portion also prevents the need for a lock on each side of the shaped member. An L-shaped member could be used instead of a T-shaped member.

Thus it is an object of the invention to provide a locking mechanism for an embossing stamp that locks the operating lever of the stamp so that the embossing seals cannot be operated when the locking mechanism is in place.

It is a related object to provide a locking mechanism that provides for different types of locks to be used such as padlocks and single use locks to determine if the lock has been tampered with.

DETAILED DESCRIPTION OF THE PREFERRED EMBODIMENT

Figure 1:
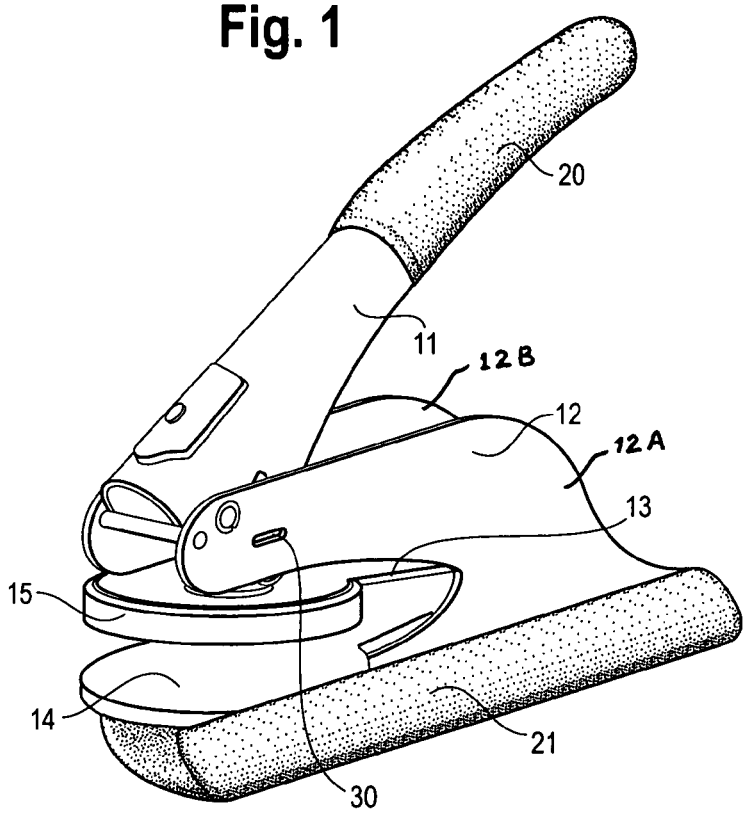
FIG. 1 is a perspective view of the locking embosser stamp without the locking member or lock illustrated.

This invention works on a hand-held or desktop embosser stamp that is well known in the art. Most often this type of embosser would be used to emboss paper, but it could also emboss an image on other materials such as metal foils.

The embosser consists essentially of a lever 11, a body 12 having opposite sides 12A and 12B, a biasing or spring mechanism, a plate 13, and a seal with positive 14 and negative 15 embossing surfaces. The lever 11 is pivotally mounted to the front portion of the body 12. The lever 11 has a hole or slot 22 cut into it which passes completely through the lever 11. Throughout this application the reference to hole, slot or opening shall be synonymous. The plate 13 is biased via the biasing mechanism to an open position. Attached to the embosser body 12 and the bottom of the plate 13 are positive 14 and negative 15 embossing surfaces. It does not matter whether the positive 14 or negative 15 embossing surface is attached to the plate 13 or the embosser body, as long as the images are aligned to be complementary. The material to be embossed is inserted between the embossing surfaces 14, 15. When the lever 11 is depressed, it depresses the plate 13 which causes the embossing surfaces 14, 15 to close and the image is embossed in the material inserted between the surfaces 14, 15. Optional features such as rubber grips 20 on the lever 11 or bottom of the embosser body 21 may also be present.

Figure 4A:
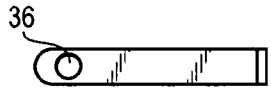
FIG. 4A is a side elevation view of an L-shaped locking member.
Figure 4B:
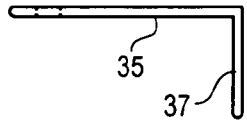
FIG. 4B is a top plan view of the L-shaped locking member.
Figure 2A:
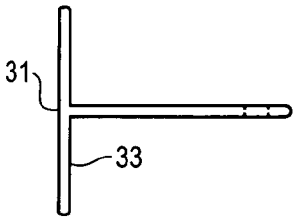
FIG. 2A is a side elevation view of the T-shaped locking member.
Figure 2B:
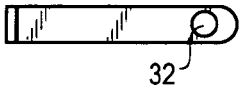
FIG. 2B is a top plan view of the T-shaped member.
Figure 3:
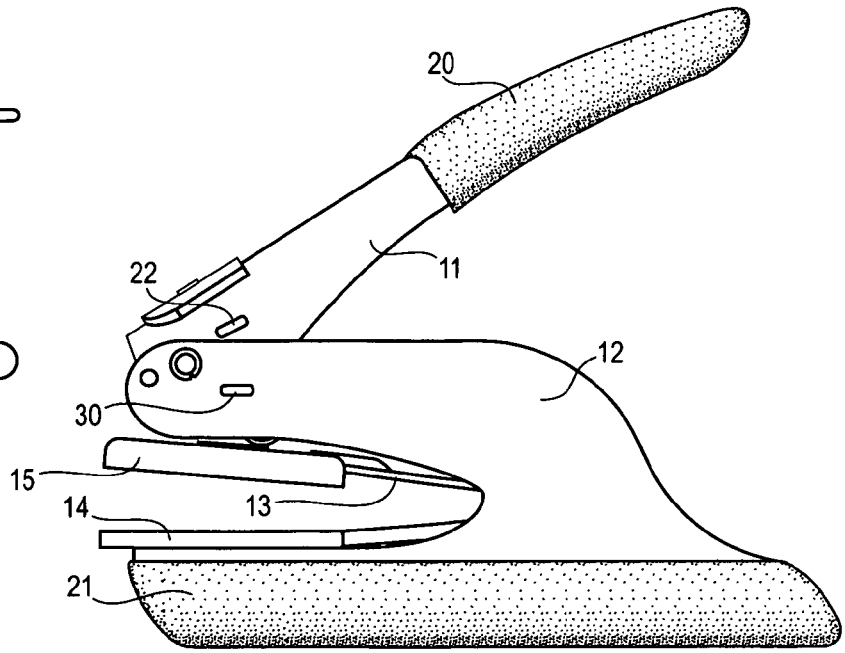
FIG. 3 is a side view of the locking embosser stamp without the T-shaped member or lock illustrated.

FIGS. 2A, 2B, 4A and 4B illustrate two forms of a locking bar or rod. FIG. 2A illustrates a T-shaped member 31 and FIG. 4A illustrates an L-shaped member 35. Alternatively the rod 31 can be cylindrical or such other shape that functions as will be described herein. The T-shaped member 31 has a vertical portion 33 and a hole 32 at one end. The L-shaped member 35 has a vertical portion 37 and a hole 36 at one end. The hole 32 or 36 is adapted to receive a lock 34. If a cylindrical rod is used, it will have the same features as the T-shaped or L-shaped member in that it will have a hole at one end and a stopping portion at the opposite end.

Slots 30 are cut through sides 12A and 12B to a size minimally larger than the cross section of the rod 31 or 35. Slot 22 is cut is cut through the lever 11 so that the slots 22 and 30 will line up when the lever 11 is in the depressed position when the embossing surfaces 14, 15 are in intimate contact with each other. In this position, no material can be inserted between the embossing surfaces 14, 15. The rod which can be as described as the T-shaped member 31, L-shaped member 35 or other similarly designed member or rod, having a width minimally larger than the slots 22 and 30 is placed through the slots 22 and 30 and a suitable lock 34 is inserted into a hole 32 at one end of the member 31 or 35. The vertical portion 33 at the opposite end of the hole 32 of the T-shaped member 31 or opposite the hole 36 in the L-shaped member 35 acts as a stop by engaging the side 12A or 12B depending on which side the member 31 or 35 is inserted. The vertical portion 33 further assists in preventing the embossing surfaces 14, 15 from being exposed and used. The vertical portion 33 also eliminates the need for a lock on each side of the T-shaped or L-shaped member 31 or 35.

In order to lock the embossing stamp, the lever 11 is depressed and the T-shaped member 31 or L-shaped member 35 is inserted through the slots 30 in the opposite sides 12A and 12B and the slots 22 in the lever 11 and the body 12. The hole 32 or 36 extends beyond the sides 12A or 12B. Subsequently, the lock 34 is inserted through the hole 32 in the T-shaped member 31 or 36 in the L-shaped member 35. This locks the embossing stamp in the closed position.

In order to unlock the embossing stamp, the lock 34 is removed and then the member 31 or 35 is removed. The lever 11 is spring loaded will return to its non-depressed position so that the embosser can be used. The T-shaped member 31 or L-shaped member 35 can be inserted from either side of the embossing stamp as long as the lock can be received in the hole 32 or hole 36 as the T-shaped member or L-shaped member exists on the other side of the embossing stamp.

Figure 5:
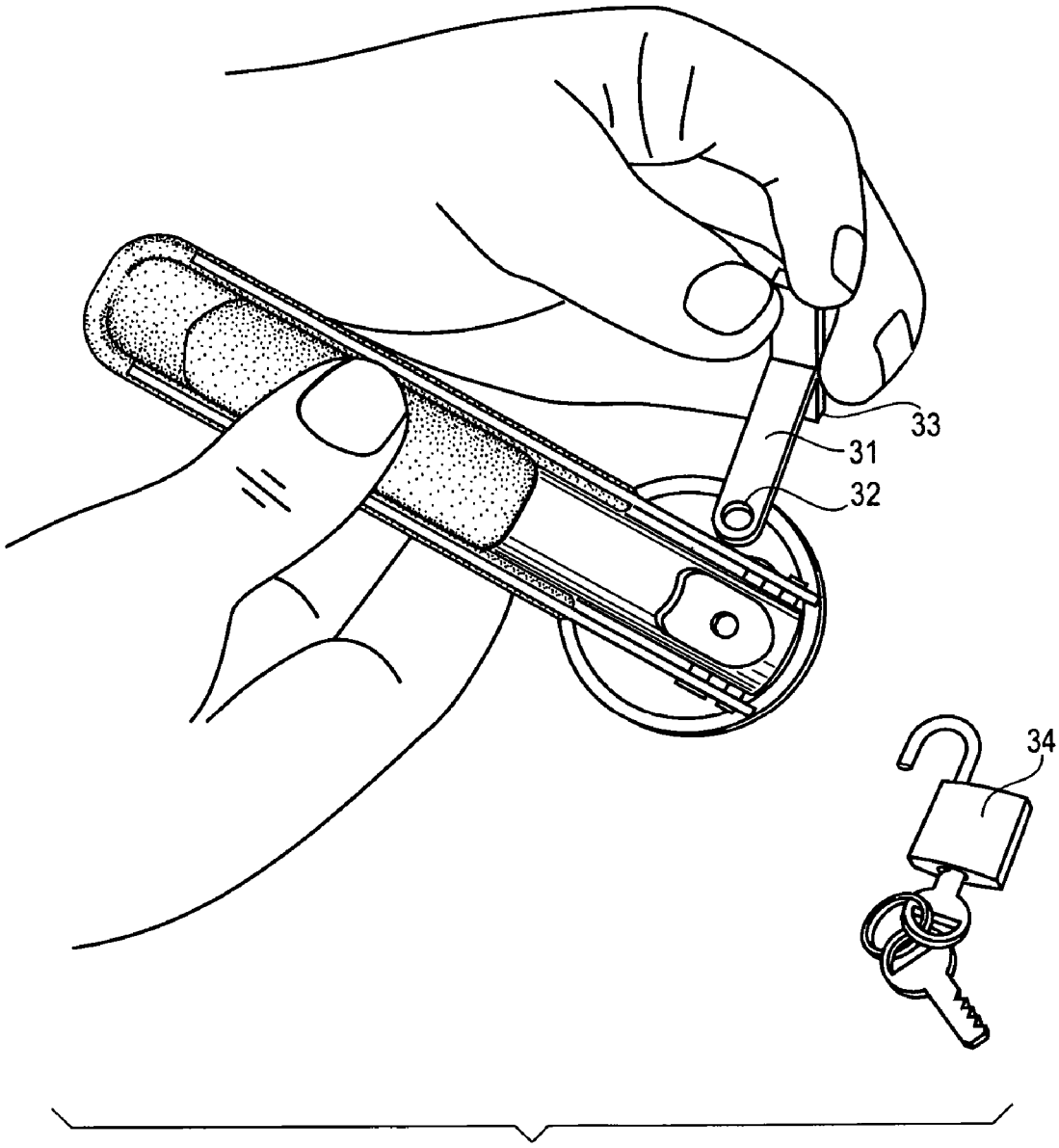
FIG. 5 is a top plan view illustrating the T-shaped member being inserted into the embosser stamp.
Figure 6:
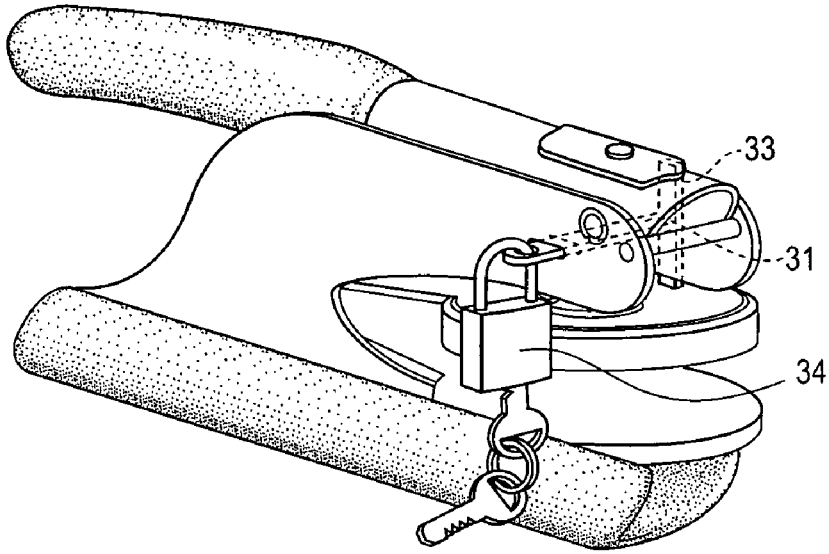
FIG. 6 is a perspective view that illustrates a perspective view of the locking embosser stamp in the locked position with a key lock as the locking means.
Figure 7A:
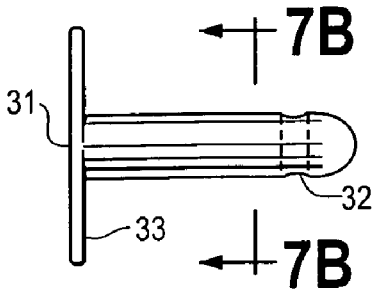
FIG. 7A is a side elevation view of a locking member having a cylindrical locking bar.
Figure 7B:
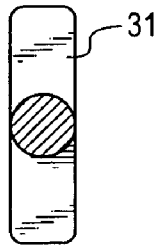
FIG. 7B is a cross sectional view taken along line 7B-7B of FIG. 7A.

The lock 34 is to be selected to fit within the size of the hole 32 or 36 in the T-shaped member. The lock 34 can be a key lock as illustrated in FIGS. 5 and 6. Other locks could also be used, such as a combination lock. Similarly, single use locks, preferably numbered, could be used such as plastic seals, plastic padlocks, steel padlock seals, shaped member seals and other tamper evident seals. When such single use locks are utilized, they provide an additional level of security over traditional locks by making sure that no one has used the embosser since it was locked with the single use lock without obvious signs of tampering or a missing single use lock.

In an alternate embodiment the locking mechanism can be designed with the slots 22 and 30 cut into the lever 11 and sides 12A and 12B so that the slots are aligned when the lever 11 is in the raised position with the embossing surfaces 14, 15 separated. The member 31 or 35 is inserted and locked so that the lever 11 cannot be depressed and the surfaces 14, 15 cannot create an impression.

Thus there has been provided a locking mechanism for an embossing stamp that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. An embosser stamp comprising:

a stamp body having opposite upstanding sides;

an embossing die mounted in the stamp body;

an operating lever disposed between the upstanding sides and having an end operatively engaging the embossing die;

a stamp body opening in each of the opposite sides of the stamp body, the stamp body openings aligned with each other in a substantially straight line;

an operator lever opening passing through the operator lever, the operator lever opening in alignment with the stamp body openings when the operator lever is in a first position and out of alignment when the operator lever is in a second position;

a locking member comprising a removable rod having an L-shaped first end and a second end opposite the first end, the removable rod being closely received within the operating lever opening and the stamp body openings, the locking member received in the stamp body openings and the operator lever opening when the stamp body openings are aligned with the operator lever opening to restrain the operator lever from movement within the stamp body and inhibiting the movement of the operating lever between the first and second positions, the locking member being removable from the stamp body.

2. The embosser stamp of claim 1 and further comprising a hole at the second end of the rod for receiving a locking device.

3. The embosser stamp of claim 1 wherein the embossing die comprises two plates and wherein the operating lever causes the embossing die plates to engage each other in the first position and to disengage from each other in the second position.

4. In an embosser stamp having a stamp frame and an operating lever mounted in the stamp frame for activating an embossing die, a locking mechanism comprising:

a first hole in the stamp frame;

a second hole in the operating lever;

a third hole in the stamp frame in alignment with the first hole;

the first, second and third holes in alignment with each other when the operating lever is in a first position, locking means which are removable from the embosser stamp and can be placed through the first, second and third holes when they are aligned with each other for restraining the movement of the operating lever with respect to the stamp frame; and wherein the locking means comprises a removable rod having a first end and a second end opposite the first end, with a hole disposed at one of the ends and a lock received in the hole.

5. The embosser stamp of claim 4 wherein the rod is T-shaped at the end opposite the end having the hole.

6. The embosser stamp of claim 4 wherein the rod is L-shaped at the end opposite the end having the hole.

7. The embosser stamp of claim 4 and further comprising stop means at the end opposite the end having the hole for positioning and maintaining the position of the rod when it is inserted into the aligned first, second and third holes.

8. A locking mechanism for an embosser stamp comprising:

an embosser stamp body;

an operating lever operatively connected to an embossing die;

a locking bar having first and second opposite ends;

a stop member at the first end and a lock receiving means at the second opposite end; and aligned slots in the embosser stamp body and operating lever, the locking bar passing through the aligned slots for restraining the operating lever in a first position.

9. The locking mechanism of claim 8 wherein the stamp body has two sides, the stop member engaging one of the sides and the lock receiving means extending out from the second side.

10. The locking mechanism of claim 9 wherein the lock receiving means comprises a hole in the locking bar for receiving a lock.

11. The locking mechanism of claim 9 wherein the stop member comprises a T-shaped member.

12. The locking mechanism of claim 9 wherein the stop member comprises an L-shaped member.

13. The locking mechanism of claim 9 wherein the locking bar has a cylindrical cross section.

* * * * *